US009664188B2

(12) United States Patent
Fujita et al.

(10) Patent No.: US 9,664,188 B2
(45) Date of Patent: May 30, 2017

(54) VARIABLE DISPLACEMENT VANE PUMP

(71) Applicant: KAYABA INDUSTRY CO., LTD., Tokyo (JP)

(72) Inventors: Tomoyuki Fujita, Gifu (JP); Masamichi Sugihara, Gifu (JP); Koichiro Akatsuka, Gifu (JP); Fumiyasu Kato, Aichi (JP)

(73) Assignee: KYB Corporation, Tokyo (JP)

( * ) Notice: Subject to any disclaimer, the term of this patent is extended or adjusted under 35 U.S.C. 154(b) by 0 days.

(21) Appl. No.: 14/431,786

(22) PCT Filed: Sep. 20, 2013

(86) PCT No.: PCT/JP2013/075434

§ 371 (c)(1),
(2) Date: Mar. 27, 2015

(87) PCT Pub. No.: WO2014/050724

PCT Pub. Date: Apr. 3, 2014

(65) Prior Publication Data

US 2015/0267700 A1 Sep. 24, 2015

(30) Foreign Application Priority Data

Sep. 28, 2012 (JP) ..... 2012-216364

(51) Int. Cl.
*F04C 15/00* (2006.01)
*F04C 15/06* (2006.01)
(Continued)

(52) U.S. Cl.
CPC ..... *F04C 14/226* (2013.01); *F04C 2/344* (2013.01); *F04C 2/3448* (2013.01); *F04C 15/06* (2013.01); *F01C 21/108* (2013.01)

(58) Field of Classification Search
CPC ..... F04C 14/226; F04C 15/06; F04C 2/344; F04C 2/3448; F01C 21/108
(Continued)

(56) References Cited

U.S. PATENT DOCUMENTS

2008/0219874 A1 9/2008 Yamamuro et al.
2011/0097231 A1 4/2011 Yamamuro et al.
2011/0189043 A1 8/2011 Watanabe et al.

FOREIGN PATENT DOCUMENTS

JP 11-013646 A 1/1999
JP 2003-097453 A 4/2003
(Continued)

OTHER PUBLICATIONS

Machine Translation JP 2003-97454 Done Feb. 17, 205.*
Machine Translation JP 2003-97453 Done Feb. 17, 205.*

*Primary Examiner* — Mark A Laurenzi
*Assistant Examiner* — Dapinder Singh
(74) *Attorney, Agent, or Firm* — Rabin & Berdo, P.C.

(57) ABSTRACT

A variable displacement vane pump includes: a rotor to be rotatively driven; a plurality of vanes slidably housed in the rotor; a cam ring allowed of eccentric with respect to a center of the rotor, the cam ring having an inner circumferential cam surface in sliding contact with a distal end portion of the vane; a pump chamber defined by the adjacent vanes, the rotor, and the cam ring; a suction port to guide hydraulic fluid to be suctioned to the pump chamber; and a discharge port to guide hydraulic fluid to be discharged from the pump chamber. An outer circumference of an opening portion of the suction port is formed so as to be positioned along the inner circumferential cam surface of the cam ring or at an outside of the inner circumferential cam surface regardless of eccentricity of the cam ring with respect to the rotor.

7 Claims, 7 Drawing Sheets

(51) Int. Cl.

| | |
|---|---|
| ***F01C 21/00*** | (2006.01) |
| ***F04C 14/22*** | (2006.01) |
| ***F04C 2/344*** | (2006.01) |
| *F01C 21/10* | (2006.01) |

(58) Field of Classification Search
USPC ..... 418/22, 26, 28, 229, 30
See application file for complete search history.

(56) References Cited

FOREIGN PATENT DOCUMENTS

| | | | |
|---|---|---|---|
| JP | 2003-097454 | A | 4/2003 |
| JP | 2007-138876 | A | 6/2007 |
| JP | 2008-215189 | A | 9/2008 |
| JP | 2011-157826 | A | 8/2011 |

* cited by examiner

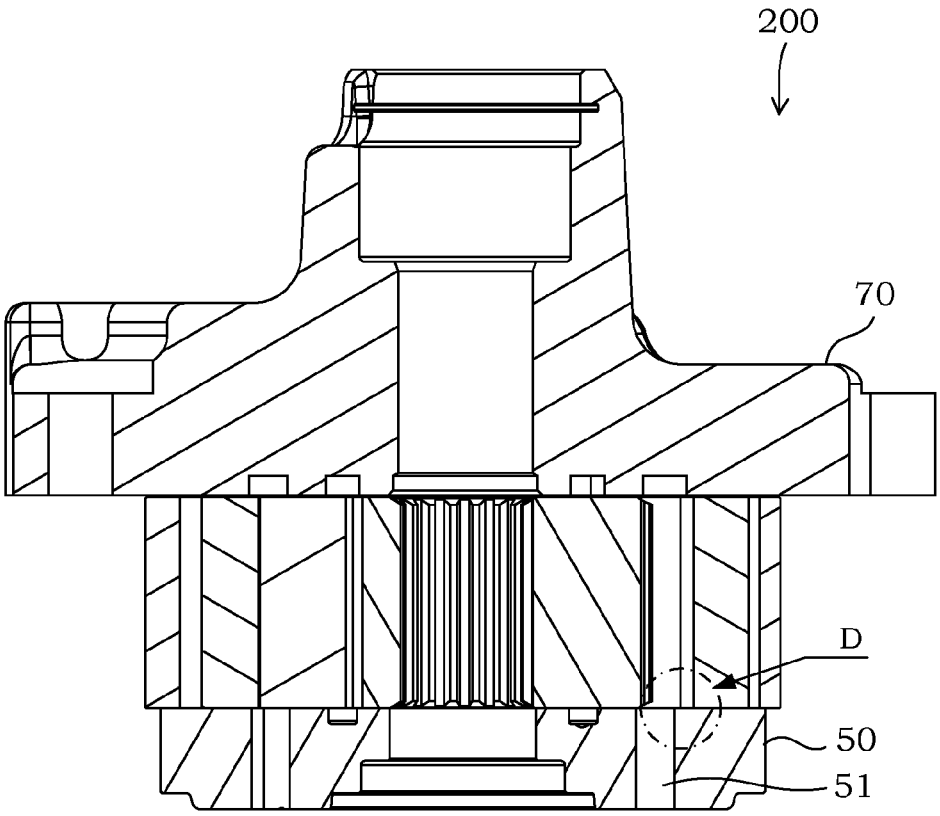
FIG. 7A
FIG. 7B
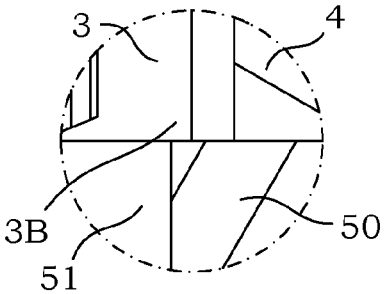
FIG. 7C
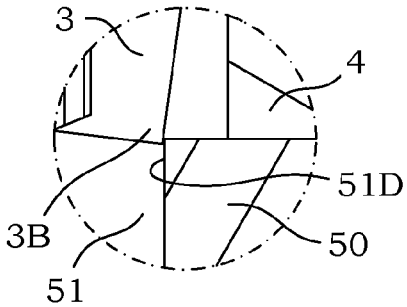

VARIABLE DISPLACEMENT VANE PUMP

FIELD OF THE INVENTION

The present invention relates to a variable displacement vane pump used as a fluid pressure supply source in fluid pressure equipment.

BACKGROUND OF THE INVENTION

In a variable displacement vane pump, a cam ring swings with a pin as a fulcrum to change eccentricity of the cam ring with respect to a rotor, whereby a discharge capacity of fluid can be changed.

JP2007-138876A discloses that suction ports are formed at both sides in an axial direction of a pump chamber and each of these suction ports is formed so as to have an arc shape along a portion between an outer circumference of a rotor and an inner circumference of a cam ring at the time of the minimum swing of the cam ring.

SUMMARY OF THE INVENTION

In the variable displacement vane pump as described above, in a case where eccentricity of the cam ring increases, an outer circumference of the suction port at a distal end side in a rotation direction is positioned inside the inner circumference of the cam ring. This causes a difference in level inside the inner circumference of the cam ring.

In a case where the rotor rotates in this state and a projecting vane becomes inclined, a corner at the distal end side of the vane falls into the suction port. There is a probability that the corner of the fallen vane is caught by an outer circumstantial surface of the suction port.

It is an object of the present invention to prevent a vane from being caught on a suction port in a variable displacement vane pump.

According to an aspect of the present invention, there is provided a variable displacement vane pump used as a fluid pressure supply source, including: a rotor configured to be rotatively driven; a plurality of vanes configured to be slidably housed in the rotor; a cam ring configured to be capable of eccentric with respect to a center of the rotor, the cam ring having an inner circumferential cam surface in sliding contact with a distal end portion of the vane; a pump chamber defined by the adjacent vanes, the rotor, and the cam ring; a suction port configured to guide hydraulic fluid to be suctioned to the pump chamber; and a discharge port configured to guide hydraulic fluid to be discharged from the pump chamber. In this case, an outer circumference of an opening portion of the suction port is formed so as to be positioned along the inner circumferential cam surface of the cam ring or at an outside of the inner circumferential cam surface regardless of eccentricity of the cam ring with respect to the rotor.

BRIEF DESCRIPTION OF THE DRAWINGS

FIG. 7A is a cross-sectional view illustrating a cross section parallel to the drive shaft of the variable displacement vane pump in the comparative example.

FIG. 7B is an enlarged view illustrating enlargement of a range D in FIG. 7A.

FIG. 7C is an enlarged view illustrating enlargement of the range D in FIG. 7A.

DESCRIPTION OF THE PREFERRED EMBODIMENT

Hereinafter, an embodiment of the present invention will be described with reference to the accompanying drawings.

Figure 1:
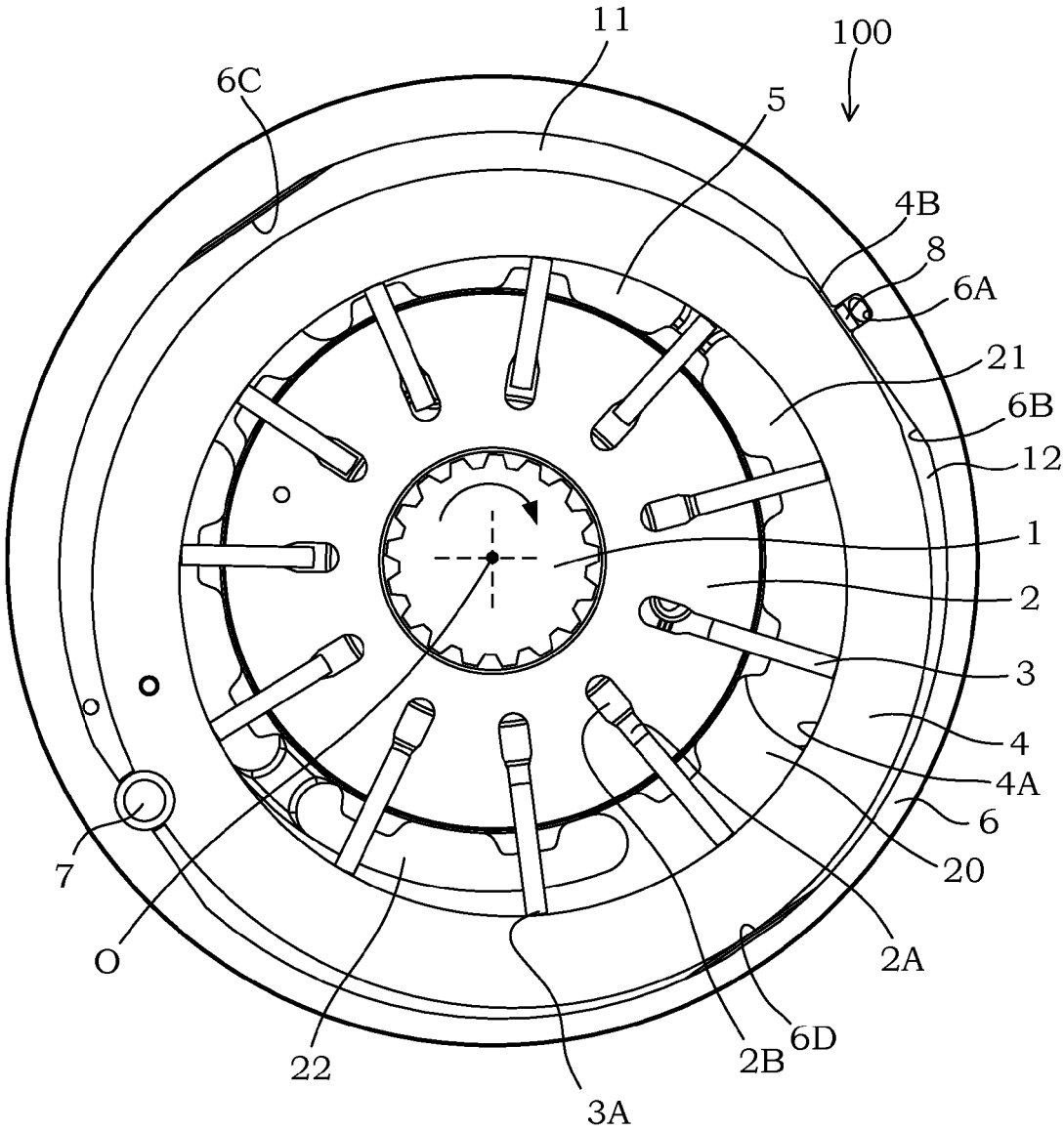
FIG. 1 is a cross-sectional view illustrating a cross section perpendicular to a drive shaft of a variable displacement vane pump according to an embodiment of the present invention.
Figure 2:
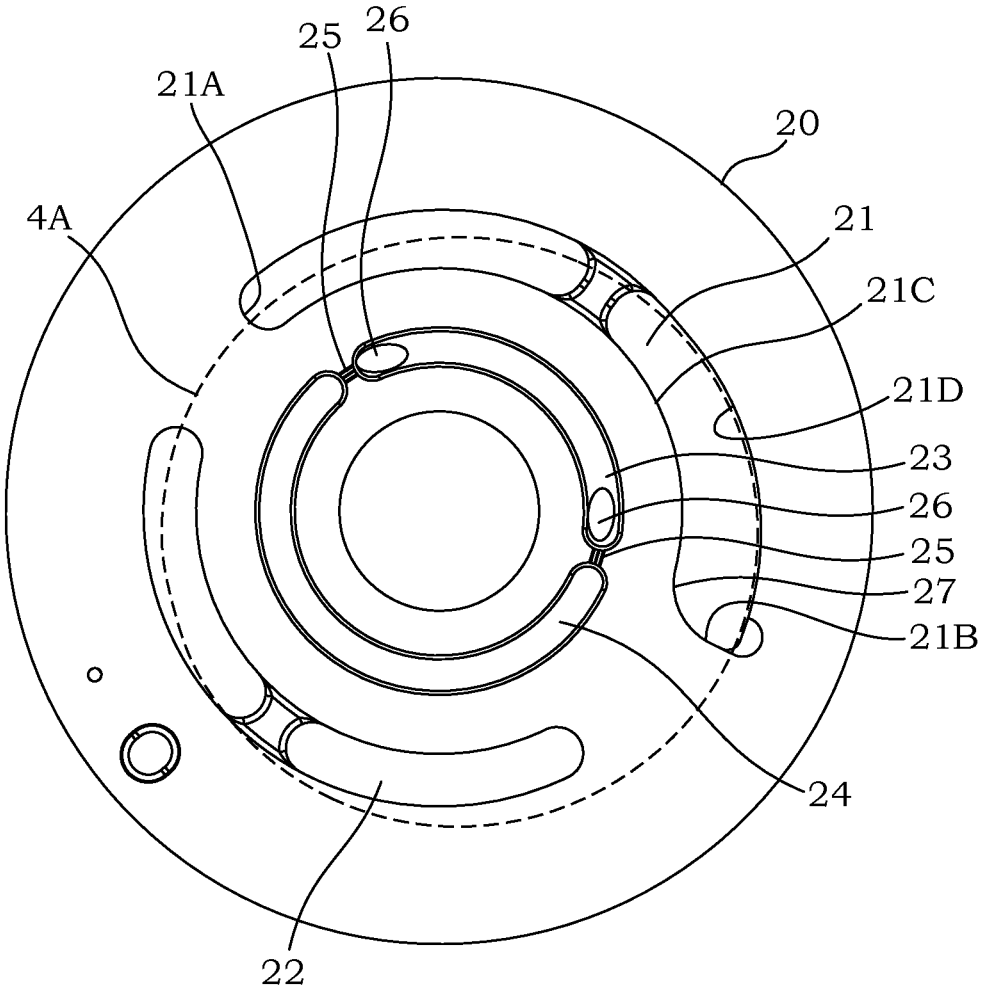
FIG. 2 is a front view of a side plate.
Figure 3A:
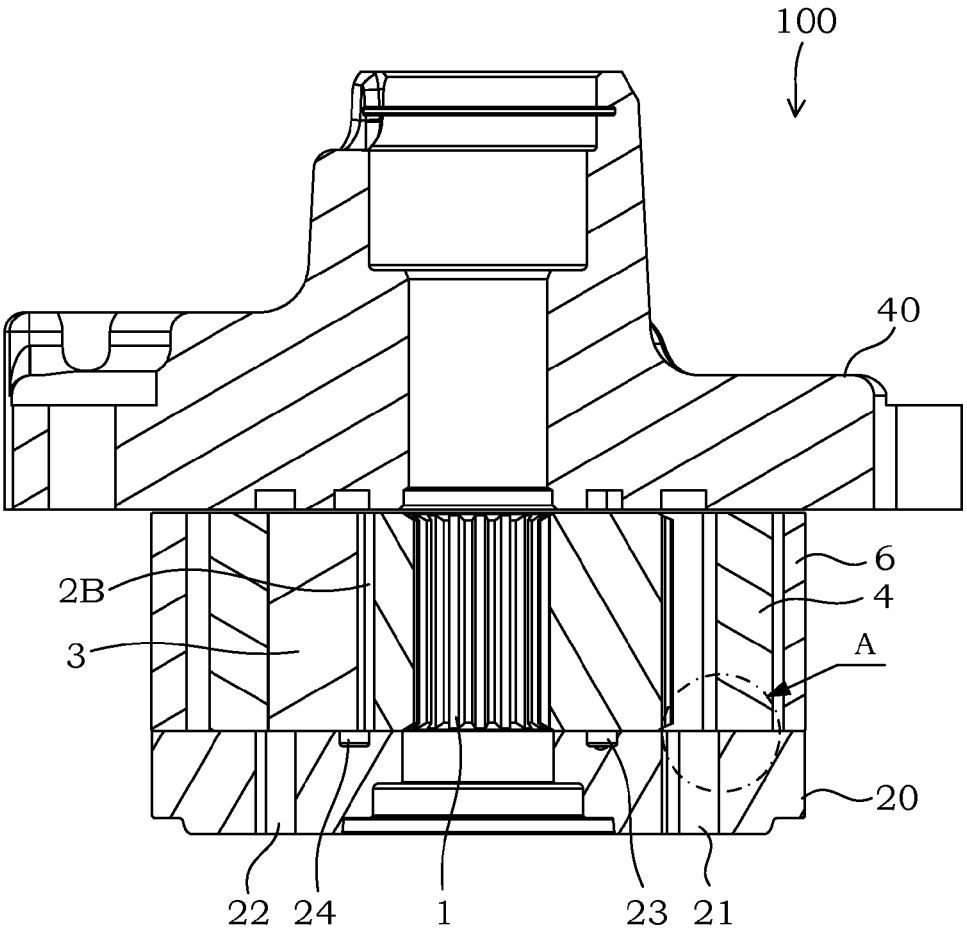
FIG. 3A is a cross-sectional view illustrating a cross section parallel to the drive shaft of the variable displacement vane pump.
Figure 4:
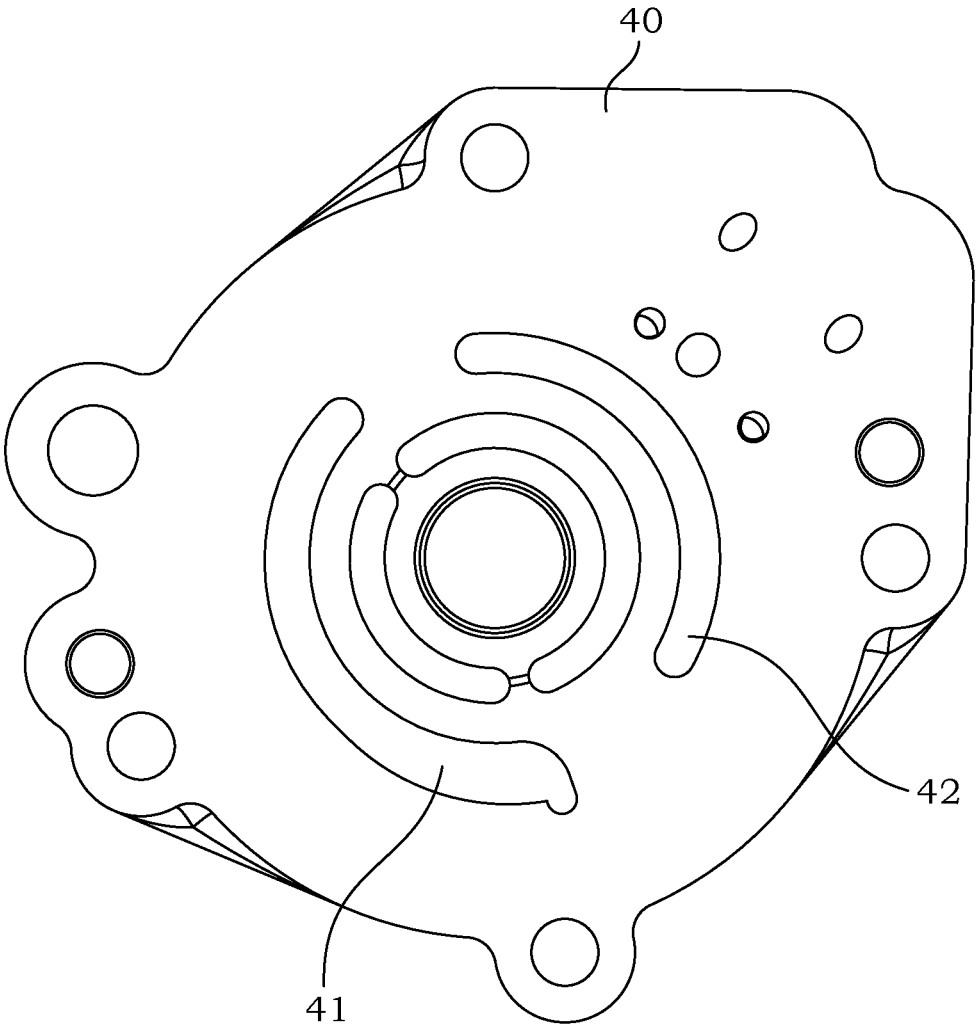
FIG. 4 is a front view of a pump cover.

FIG. 1 is a cross-sectional view illustrating a cross section perpendicular to a drive shaft 1 of a variable displacement vane pump 100 according to the present embodiment. FIG. 2 is a front view of a side plate 20. FIG. 3A is a cross-sectional view illustrating a cross section parallel to the drive shaft 1 of the variable displacement vane pump 100. FIG. 4 is a front view of a pump cover 40.

The variable displacement vane pump (hereinafter, referred to as a "vane pump") 100 is used as hydraulic equipment (fluid pressure equipment) to be mounted on a vehicle, such as a hydraulic (fluid pressure) supply source for a power steering device, a continuously variable transmission, and the like, for example.

The vane pump 100 is driven by, for example, an engine (not shown in the drawings) or the like. By rotating a rotor 2 coupled to the drive shaft 1 in the clockwise direction as illustrated by an arrow in FIG. 1, a hydraulic pressure is generated.

The vane pump 100 includes a plurality of vanes 3 and a cam ring 4. The vanes 3 are reciprocatably provided in a radial direction with respect to the rotor 2. The rotor 2 and the vanes 3 are housed in the cam ring 4.

In the rotor 2, slits 2A each having an opening portion on an outer circumstantial surface of the rotor 2 are radially formed at a predetermined interval. The vane 3 is slidably inserted into the slit 2A. A vane back-pressure chamber 2B to which a pump discharge pressure is introduced is defined at a base end side of the slit 2A. The vane 3 is pressed in a direction to project from the slit 2A by means of the pressure of the vane back-pressure chamber 2B.

The drive shaft 1 is rotatably supported on a pump body (not shown in the drawings). A pump-housing depressed portion (not shown in the drawings) that houses the cam ring 4 is formed in the pump body. The side plate 20 (in FIG. 3A) is arranged on a bottom surface of the pump-housing depressed portion. The side plate 20 comes into contact with one side of the rotor 2 and one side of the cam ring 4 in an axial direction. An opening portion of the pump-housing depressed portion is sealed by a pump cover 40 (in FIG. 3A) that comes into contact with the other side of the rotor 2 and the other side of the cam ring 4. The pump cover 40 and the side plate 20 are arranged in a state that the pump cover 40 and the side plate 20 sandwich both side surfaces of the rotor 2 and both side surfaces of the cam ring 4. A pump chamber 5 that is partitioned by the respective vanes 3 is defined between the rotor 2 and the cam ring 4.

As illustrated in FIG. 2, a suction port 21 and a discharge port 22 are formed in the side plate 20. The suction port 21 guides hydraulic oil into the pump chamber 5. The discharge port 22 draws the hydraulic oil inside of the pump chamber 5 to guide the drawn hydraulic oil to the hydraulic equipment.

As illustrated in FIG. 4, as well as the side plate 20, a suction port 41 and a discharge port 42 are formed in the pump cover 40. The suction port 41 and the discharge port 42 of the pump cover 40 are respectively communicated with the suction port 21 and the discharge port 22 of the side plate 20 via the pump chamber 5.

The cam ring 4 is an annular member, and has an inner circumferential cam surface 4A in sliding contact with a distal end portion 3A of the vane 3. A suction area and a discharge area are formed in this inner circumferential cam surface 4A. In the suction area, the hydraulic oil is suctioned via the suction port 21 in association with rotation of the rotor 2. In the discharge area, the hydraulic oil is discharged via the discharge port 22.

The suction port 21 is communicated with a tank (not shown in the drawings) through a suction passage (not shown in the drawings). The hydraulic oil in the tank is supplied to the pump chamber 5 from the suction port 21 through the suction passage.

The discharge port 22 is communicated with a hyperbaric chamber (not shown in the drawings) formed in the pump body so as to pass through the side plate 20. The hyperbaric chamber is communicated with hydraulic equipment (not shown in the drawings) outside the vane pump 100 through a discharge passage (not shown in the drawings). The hydraulic oil discharged from the pump chamber 5 is supplied to the hydraulic equipment through the discharge port 22, the hyperbaric chamber, and the discharge passage.

As illustrated in FIG. 2, back-pressure ports 23 and 24 are formed in the side plate 20. The back-pressure ports 23 and 24 are communicated with the vane back-pressure chamber 2B. Grooves 25 are formed in the side plate 20. Each of the grooves 25 communicates one of both ends of the back-pressure port 23 with one of both ends of the back-pressure port 24, respectively. The back-pressure port 23 is communicated with the hyperbaric chamber via through-holes 26 each of which passes through the side plate 20. The hydraulic oil pressure discharged from the pump chamber 5 is introduced to the vane back-pressure chamber 2B through the discharge port 22, the hyperbaric chamber, the through-holes 26, and the back-pressure ports 23 and 24. The vanes 3 are pressed by means of the hydraulic oil pressure of the vane back-pressure chamber 2B in the direction to project from the rotor 2 toward the cam ring 4.

At the time of an operation of the vane pump 100, by a biasing force of the hydraulic oil pressure of the vane back-pressure chamber 2B to press base end portions of the vanes 3 and a centrifugal force that acts in association with rotation of the rotor 2, the vanes 3 are biased in the direction to project from the slits 2A. Thus, the distal end portions 3A of the vanes 3 come into sliding contact with the inner circumferential cam surface 4A of the cam ring 4.

In the suction area of the cam ring 4, the vanes 3 in sliding contact with the inner circumferential cam surface 4A project from the rotor 2 so as to expand the pump chamber 5. Thus, the hydraulic oil is suctioned into the pump chamber 5 from the suction port 21. In the discharge area of the cam ring 4, the vanes 3 in sliding contact with the inner circumferential cam surface 4A are pressed into the rotor 2 so as to contract the pump chamber 5. Thus, the hydraulic oil pressurized at the pump chamber 5 is discharged from the discharge port 22.

Hereinafter, a configuration in which a discharge capacity (a displacement volume) of the vane pump 100 is changed will be described.

The vane pump 100 includes an annular adapter ring 6 that surrounds the cam ring 4. A support pin 7 is interposed between the adapter ring 6 and the cam ring 4. The support pin 7 supports the cam ring 4. The cam ring 4 swings with the support pin 7 as a fulcrum at an inside of the adapter ring 6 and is eccentric with respect to a center O of the rotor 2.

A sealing material 8 is interposed in a groove 6A of the adapter ring 6. The sealing material 8 comes into sliding contact with an outer circumstantial surface 4B of the cam ring 4 at the time of swing of the cam ring 4. A first fluid pressure chamber 11 and a second fluid pressure chamber 12 are defined between the outer circumstantial surface 4B of the cam ring 4 and an inner circumstantial surface 6B of the adapter ring 6 by means of the support pin 7 and the sealing material 8.

The cam ring 4 swings with the support pin 7 as a fulcrum in accordance with a pressure difference between the first fluid pressure chamber 11 and the second fluid pressure chamber 12. When the cam ring 4 swings, eccentricity of the cam ring 4 with respect to the rotor 2 is changed and the discharge capacity of the pump chamber 5 is thereby changed. When the cam ring 4 swings in a counterclockwise direction with respect to the support pin 7 in FIG. 1, the eccentricity of the cam ring 4 with respect to the rotor 2 decreases, and the discharge capacity of the pump chamber 5 thereby decreases. In contrast, when the cam ring 4 swings in a clockwise direction with respect to the support pin 7 as illustrated in FIG. 1, the eccentricity of the cam ring 4 with respect to the rotor 2 increases, and the discharge capacity of the pump chamber 5 thereby increases.

On the inner circumstantial surface 6B of the adapter ring 6, each of a restricting portion 6C and a restricting portion 6D is formed so as to bulge. The restricting portion 6C restricts movement of the cam ring 4 in the direction to decrease the eccentricity with respect to the rotor 2. The restricting portion 6D restricts movement of the cam ring 4 in the direction to increase the eccentricity with respect to the rotor 2. Namely, the restricting portion 6C defines the minimum eccentricity of the cam ring 4 with respect to the rotor 2, while the restricting portion 6D defines the maximum eccentricity of the cam ring 4 with respect to the rotor 2.

The pressure difference between the first fluid pressure chamber 11 and the second fluid pressure chamber 12 is controlled by a control valve (not shown in the drawings). The control valve controls the hydraulic oil pressures of the first fluid pressure chamber 11 and the second fluid pressure chamber 12 so that the eccentricity of the cam ring 4 with respect to the rotor 2 becomes smaller in association with an increase in a rotation speed of the rotor 2.

Hereinafter, the suction port 21 will be described.

As illustrated in FIG. 2, the suction port 21 provided in the side plate 20 is formed in an arc shape around the center O of the rotor 2. The suction port 21 includes a communication-start side end portion 21A and a communication-termination side end portion 21B. At the communication-start side end portion 21A, the communication with the pump chamber 5 starts in association with rotation of the rotor 2. At the communication-termination side end portion 21B, the communication with the pump chamber 5 terminates in association with rotation of the rotor 2.

An opening-portion inner circumference (an inner circumference of an opening portion) 21C of the suction port 21 is formed so as to have a constant diameter from the communication-start side end portion 21A to the communication-termination side end portion 21B. On the other hand, an opening-portion outer circumference (an outer circumference of an opening portion) 21D of the suction port 21 is formed so as to have a diameter gradually expanded from the communication-start side end portion 21A toward the communication-termination side end portion 21B. Namely, an opening width of the suction port 21 at a communication termination side is larger than an opening width of the suction port 21 at a communication start side.

In a case where a center of the cam ring 4 corresponds with the center O of the rotor 2 and the eccentricity of the cam ring 4 is thus zero, an opening-portion outer circumference 21D of the suction port 21 at the communication start side is positioned along the inner circumferential cam surface 4A of the cam ring 4. On the other hand, in a case where the center of the cam ring 4 is displaced with respect to the center O of the rotor 2 and the eccentricity of the cam ring 4 becomes the maximum, the opening-portion outer circumference 21D of the suction port 21 at the communication termination side is positioned along the inner circumferential cam surface 4A of the cam ring 4.

Therefore, the opening-portion outer circumference 21D of the suction port 21 is always positioned along the inner circumferential cam surface 4A of the cam ring 4 or at an outside of the inner circumferential cam surface 4A regardless of the eccentricity of the cam ring 4.

Further, a guiding portion 27 is provided at the opening-portion inner circumference 21C of the suction port 21 at the communication termination side. The guiding portion 27 is a part of the opening-portion inner circumference 21C, and is formed in a smooth-shaped manner so that the opening-portion inner circumference 21C gradually approaches the opening-portion outer circumference 21D toward the communication-termination side end portion 21B. The communication-termination side end portion 21B, at which the opening-portion inner circumference 21C reaches the opening-portion outer circumference 21D, is formed as a shape that the opening-portion inner circumference 21C is made in an arc shape toward the opening-portion outer circumference 21D side in order to avoid a situation in which an angle formed by the opening-portion inner circumference 21C and the opening-portion outer circumference 21D becomes a right angle. This prevents reduction in processability of the suction port 21.

As illustrated in FIG. 4, the suction port 41 provided in the pump cover 40 is also formed in a shape corresponding to that of the suction port 21 provided in the side plate 20 in order to prevent bias of the hydraulic oil to be introduced to the pump chamber 5.

Here, a vane pump 200 in a comparative example will be described.

Figure 5:
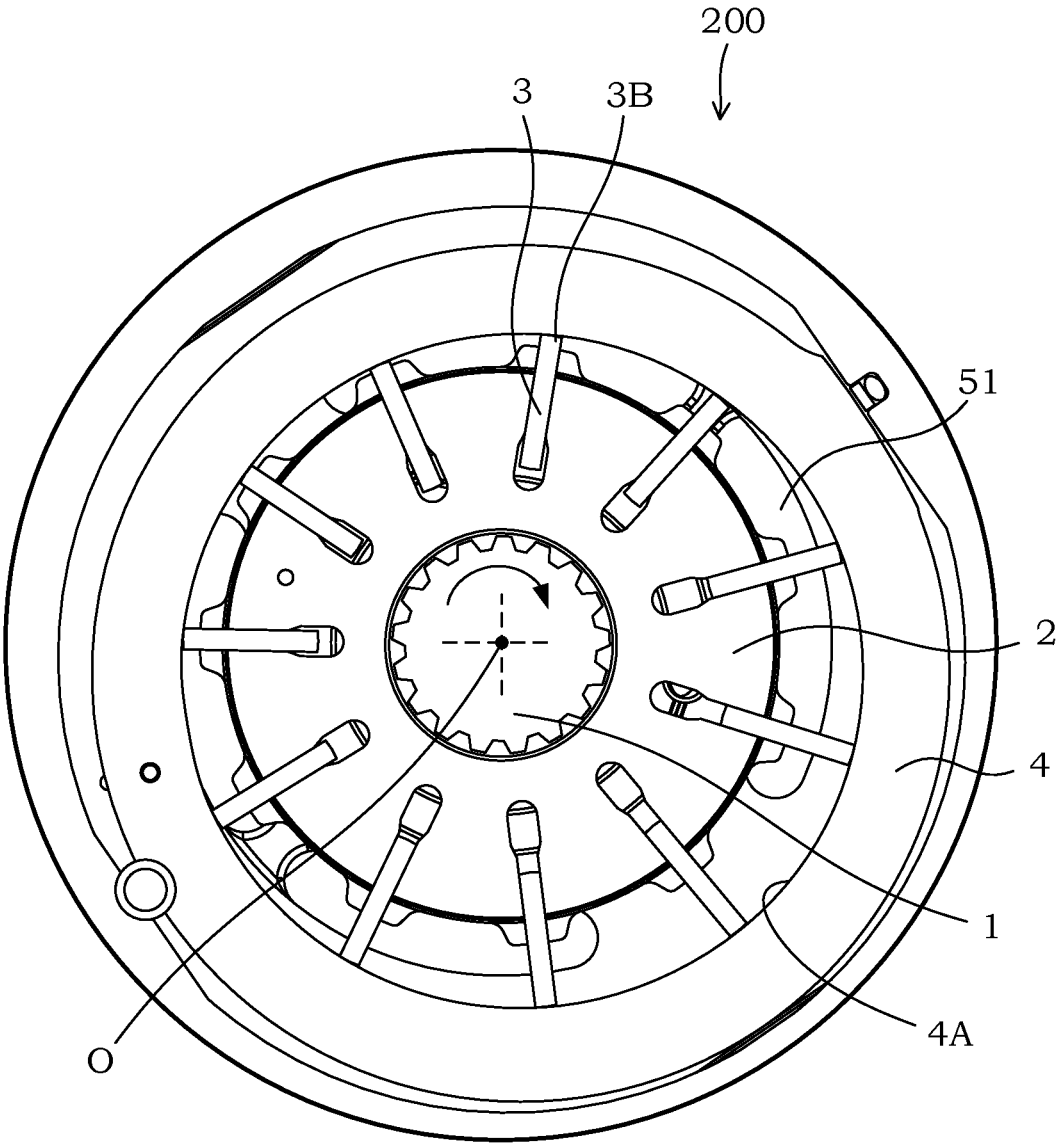
FIG. 5 is a cross-sectional view illustrating a cross section perpendicular to a drive shaft of a variable displacement vane pump in a comparative example.
Figure 6:
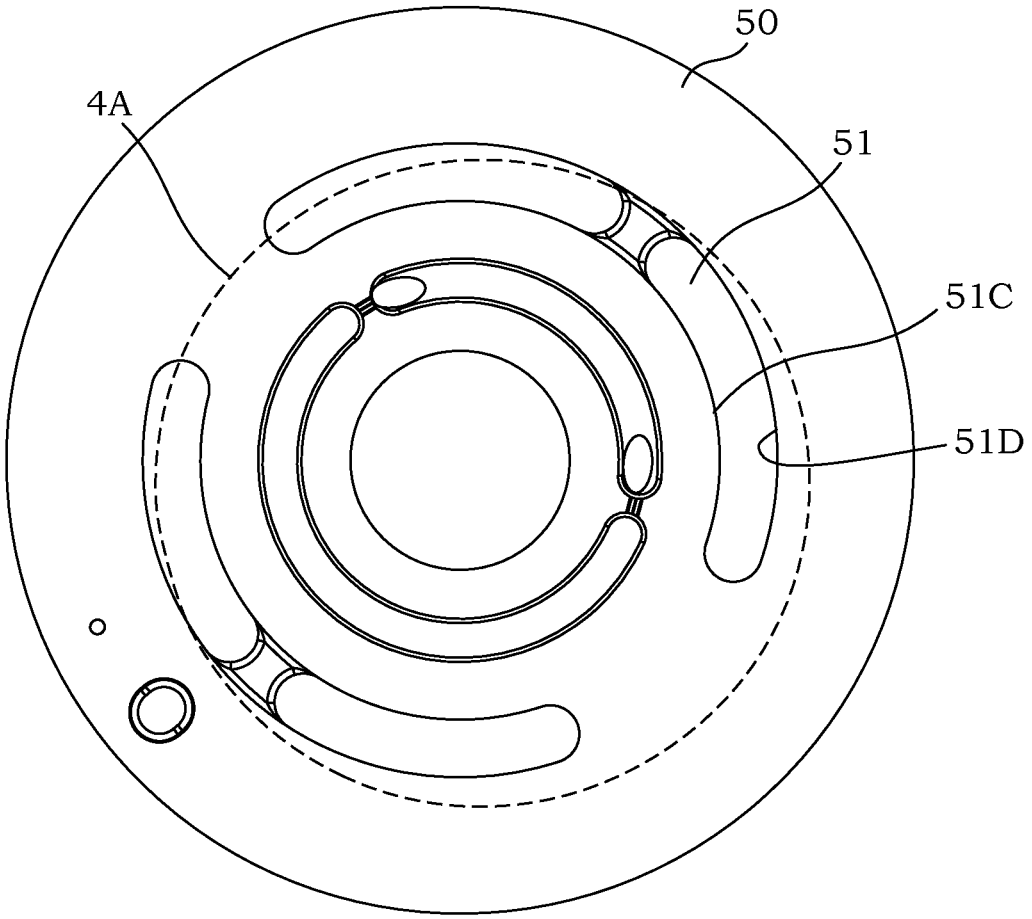
FIG. 6 is a front view of a side plate in the comparative example.

FIG. 5 is a cross-sectional view illustrating a cross section perpendicular to a drive shaft 1 of the variable displacement vane pump 200 in the comparative example. FIG. 6 is a front view of a side plate 50 in the comparative example.

In the vane pump 200 in the comparative example, both of an opening-portion inner circumference 51C and an opening-portion outer circumference 51D of a suction port 51 are formed in an arc shape around a center O of a rotor 2. Opening widths are constant from a communication start side to a communication termination side (in FIG. 6). Namely, in a case where eccentricity of a cam ring 4 is zero, the opening-portion outer circumference 51D of the suction port 51 is positioned along an inner circumferential cam surface 4A of the cam ring 4.

Therefore, when the eccentricity of the cam ring 4 increases, the inner circumferential cam surface 4A of the cam ring 4 is displaced from the suction port 51 as illustrated by a dotted line in FIG. 6. Thus, at the communication termination side, the opening-portion outer circumference 51D of the suction port 51 is positioned inside the inner circumferential cam surface 4A of the cam ring 4 (in FIG. 5 and FIG. 6).

When the rotor 2 rotates, a distal end side of a vane 3 comes into sliding contact with the inner circumferential cam surface 4A of the cam ring 4, and side surfaces of the vane 3 come into sliding contact with the side plate 50 and a pump cover 70. In a case where a force in a direction of the side surface acts on the vane 3 while the suction port 51 is positioned at the side surface of the vane 3, the vane 3 is inclined and a corner 3B at the distal end side of the vane 3 falls into the suction port 51. When the rotor 2 further rotates at this state and the vane 3 then reaches a position at which the opening-portion outer circumference 51D of the suction port 51 comes to the inside of the inner circumferential cam surface 4A of the cam ring 4, there is a probability that the corner 3B of the fallen vane 3 is caught by the opening-portion outer circumference 51D of the suction port 51.

FIG. 7A is a cross-sectional view illustrating a cross section parallel to the drive shaft 1 of the variable displacement vane pump 200 in the comparative example. FIG. 7B is an enlarged view illustrating enlargement of a range D in FIG. 7A. FIG. 7C is an enlarged view illustrating enlargement of the range D in FIG. 7A in a case where the vane 3 is caught.

A right side of FIG. 7A illustrates a cross section in a case where the vane 3 is positioned at the communication termination side with respect to the center of the suction port 51. In a case where the vane 3 is not inclined, as illustrated in FIG. 7B, the corner 3B at the distal end side of the vane 3 is in sliding contact with the side plate 50 without falling into the suction port 51. In a case where the vane 3 is inclined, as illustrated in FIG. 7C, there is a probability that the corner 3B at the distal end side of the vane 3 falls into the suction port 51 and is caught by the opening-portion outer circumference 51D of the suction port 51.

Therefore, in this embodiment, the opening-portion outer circumference 21D of the suction port 21 is expanded toward an outer circumference side compared with that in the comparative example as illustrated in FIG. 2. An expanded width is set to the extent that the opening-portion outer circumference 21D of the suction port 21 is not positioned at the inside of the inner circumferential cam surface 4A of the cam ring 4 even though the eccentricity of the cam ring 4 becomes the maximum.

Figure 3B:
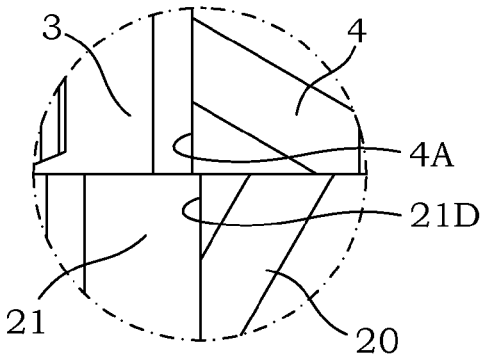
FIG. 3B is an enlarged view illustrating enlargement of a range A in FIG. 3A.

Accordingly, when the cross section parallel to the drive shaft 1 at the communication termination side with respect to the center of the suction port 21 is viewed, as illustrated in FIG. 3B, the opening-portion outer circumference 21D of the suction port 21 is positioned at the outside of the inner circumferential cam surface 4A of the cam ring 4. Thus, even if the vane 3 is inclined, the corner at the distal end side of the vane 3 is not caught by the suction port 21.

Additionally, as illustrated in FIG. 2, at an end portion of the suction port 21 on the communication termination side, the guiding portion 27 is provided so that the opening-portion inner circumference 21C gradually approaches the outer circumference side. For this reason, it is possible to gradually lift the distal end side of the vane 3 that has fallen into the suction port 21 in association with rotation of the rotor 2.

According to the embodiments described above, it is possible to obtain the following effects.

The opening-portion outer circumference 21D of the suction port 21 is formed so as to be positioned at the outside of the inner circumferential cam surface 4A of the cam ring 4 regardless of the eccentricity of the cam ring 4. For this reason, it is possible to prevent a difference in level at the inside of the inner circumference of the cam ring 4 from occurring. Therefore, it is possible to prevent the corner 3B at the distal end side of the vane 3 that has fallen into the suction port 21 from being caught by the opening-portion outer circumference 21D of the suction port 21 regardless of the eccentricity of the cam ring 4.

Moreover, in the communication-termination side end portion 21B of the suction port 21, the guiding portion 27 is formed so that the opening-portion inner circumference 21C gradually approaches the opening-portion outer circumference 21D toward the communication-termination side end portion 21B. For this reason, it is possible to gradually lift the distal end side of the vane 3 that has fallen into the suction port 21 in association with rotation of the rotor 2, and this makes it possible to more reliably prevent the corner 3B at the distal end side of the vane 3 from being caught by opening-portion outer circumference 21D of the suction port 21.

Moreover, the opening-portion outer circumference 21D of the suction port 21 is formed so as to approach the inner circumferential cam surface 4A of the cam ring 4 as the eccentricity of the cam ring 4 increases. For this reason, in a case where the rotation speed of the rotor 2 is low and the eccentricity of the cam ring 4 is large, the difference in level between the inner circumferential cam surface 4A and the opening-portion outer circumference 21D of the suction port 21 becomes small. This makes it possible to suppress a flow passage resistance of the hydraulic oil at the beginning of rotation.

Moreover, the opening-portion outer circumference 21D of the suction port 21 is formed so as to be positioned along the inner circumferential cam surface 4A of the cam ring 4 in a case where the cam ring 4 is in the maximum eccentricity position. For this reason, in a case where the eccentricity between the center O of the rotor 2 and the center of the cam ring 4 becomes the maximum, the inner circumferential cam surface 4A and the opening-portion outer circumference 21D of the suction port 21 form approximately a flat surface. This makes it possible to suppress the flow passage resistance of the hydraulic oil. In addition, it is possible to minimize deterioration in rigidity of the side plate 20 and the pump cover 40 due to expansion of the opening-portion outer circumference 21D of the suction port 21 toward the outer circumference side.

Moreover, the opening width of the suction port 21 is larger at the communication termination side than that at the communication start side. For this reason, it is possible to increase an opening area of the suction port 21 in response to the expansion of the pump chamber 5 in association with rotation of the rotor 2. This makes it possible to increase a suction efficiency of the hydraulic oil and to suppress cavitation from occurring.

The embodiment of the present invention has been described above, but the above embodiment is merely one of examples of applications of the present invention, and the technical scope of the present invention is not limited to the specific configurations of the above embodiment.

The present application claims priority based on Japanese Patent Application No. 2012-216364 filed with the Japan Patent Office on Sep. 28, 2012, the entire content of which is incorporated into the present specification by reference.

The invention claimed is:

1. A variable displacement vane pump used as a fluid pressure supply source, comprising:

a rotor configured to be rotatively driven;

a plurality of vanes configured to be slidably housed in the rotor;

a support pin;

a cam ring configured to swing with the support pin, which serves as a fulcrum of the cam ring, so as to change eccentricity of the cam ring with respect to a center of the rotor, the cam ring having an inner circumferential cam surface in sliding contact with a distal end portion of the vanes;

a pump chamber defined by the rotor, the cam ring and adjacent ones of the vanes;

a suction port configured to guide hydraulic fluid to be suctioned to the pump chamber; and a discharge port configured to guide hydraulic fluid to be discharged from the pump chamber, wherein an outer circumference of an opening portion of the suction port is formed so as to be positioned along the inner circumferential cam surface of the cam ring or at an outside of the inner circumferential cam surface regardless of the eccentricity of the cam ring with respect to the rotor, wherein the opening portion includes a communication-start side end portion having a communication-start end at which communication between the opening portion and the pump chamber starts in association with rotation of the rotor, and a communication-termination side end portion having a communication-termination end at which the communication between the opening portion and the pump chamber ends in association with the rotation of the rotor, wherein an inner circumference of the opening portion includes a guiding portion at the communication-termination side end portion, and wherein the guiding portion is formed in an arc-shaped manner so that the inner circumference gradually approaches the outer circumference of the opening portion in a direction toward the communication-termination end.

2. The variable displacement vane pump according to claim 1, wherein the outer circumference of the opening portion at the communication-termination side end portion is formed so as to approach the inner circumferential cam surface of the cam ring as the eccentricity of the cam ring with respect to the center of the rotor increases.

3. The variable displacement vane pump according to claim 2, wherein the outer circumference of the opening portion at the communication-termination side end portion is formed so as to be positioned along the inner circumferential cam surface of the cam ring in a case where the cam ring is at a maximum eccentricity position with respect to the center of the rotor.

4. The variable displacement vane pump according to claim 1, wherein an opening width of the suction port at the communication-termination side end portion is larger than an opening width of the suction port at the communication-start side end portion.

5. The variable displacement vane pump according to claim 1, wherein the communication-termination side end portion is formed so as to protrude toward an outside of the opening portion.

6. The variable displacement vane pump according to claim 1, wherein a center of an arc of the arc shape is positioned at the opening portion.

7. The variable displacement vane pump according to claim 1, wherein the guiding portion does not form a right angle.

* * * * *